US007240394B2

(12) United States Patent
Kegg et al.

(10) Patent No.: US 7,240,394 B2
(45) Date of Patent: Jul. 10, 2007

(54) CLEANING MACHINE FOR CLEANING A SURFACE

(75) Inventors: Steven W. Kegg, Uniontown, OH (US); Deborah R. Tucker, Uniontown, OH (US); Craig M. O'Briskie, Uniontown, OH (US); Donald A. Coates, Canton, OH (US)

(73) Assignee: The Hoover Company, North Canton, OH (US)

( * ) Notice: Subject to any disclaimer, the term of this patent is extended or adjusted under 35 U.S.C. 154(b) by 561 days.

(21) Appl. No.: 10/730,305

(22) Filed: Dec. 6, 2003

(65) Prior Publication Data

US 2005/0120507 A1 Jun. 9, 2005

(51) Int. Cl.
*A47L 9/18* (2006.01)

(52) U.S. Cl. ..... 15/320; 15/319; 15/347

(58) Field of Classification Search ..... 15/319, 15/320, 347, 353

See application file for complete search history.

(56) References Cited

U.S. PATENT DOCUMENTS

| | | | | | |
|---|---|---|---|---|---|
| 3,996,640 | A | * | 12/1976 | Blue et al. | 15/320 |
| 4,377,017 | A | * | 3/1983 | Herpers et al. | 15/320 |
| 4,464,810 | A | * | 8/1984 | Karpanty | 15/320 |
| 4,667,364 | A | * | 5/1987 | Meili | 15/320 |
| 4,741,069 | A | | 5/1988 | Helm et al. | 15/320 |
| 5,331,713 | A | | 7/1994 | Tipton | 15/320 |
| 5,535,476 | A | | 7/1996 | Kresse et al. | 15/320 |
| 5,783,086 | A | | 7/1998 | Scanlon et al. | 210/651 |
| 5,907,887 | A | | 6/1999 | Mansur | 15/320 |
| 5,946,769 | A | | 9/1999 | Sprinkle | 15/321 |
| 6,381,801 | B1 | * | 5/2002 | Clemons, Sr. | 15/320 |
| 6,446,302 | B1 | | 9/2002 | Kasper et al. | 15/319 |

FOREIGN PATENT DOCUMENTS

| | | |
|---|---|---|
| GB | 2274977 A | 8/1994 |
| WO | WO 02/21429 | 4/2000 |

* cited by examiner

*Primary Examiner*—Theresa T. Snider
(74) *Attorney, Agent, or Firm*—Renner, Kenner, Greive, Bobak, Taylor & Weber

(57) ABSTRACT

A cleaning apparatus for cleaning a surface in which cleaning solution is distributed to the surface and substantially simultaneously extracted along with the dirt on the surface in a continuous operation as it moves along the surface is provided. The cleaning apparatus includes a housing and a liquid distribution system operatively associated with the housing. The liquid distribution system includes a fluid source providing a supply of the cleaning solution and a distributor fluidly connected to the fluid source for distributing the cleaning solution to the surface. A liquid recovery system is operatively associated with the housing and includes a suction nozzle and a recovery tank removably mounted to the housing and in fluid communication with the suction nozzle. A suction source is in fluid communication with the suction nozzle for applying suction to draw the cleaning solution and dirt from the surface through the suction nozzle and into the recovery tank. A filter system is provided on the housing and in fluid communication with the recovery tank for filtering the recovered cleaning solution to be reused. The filter system includes a first filter provided on a filter support mounted to the recovery tank for filtering particles from the cleaning solution and dirt, and a second filter fluidly connected between the recovery tank and the distributor for filtering particles from the cleaning solution and dirt of a smaller size than the particles filtered from the first filter.

21 Claims, 3 Drawing Sheets

CLEANING MACHINE FOR CLEANING A SURFACE

BACKGROUND OF THE INVENTION

1. Field of the Invention

The present invention relates to a portable cleaning machine for cleaning a surface.

2. Background Information

It is know to have cleaning machines for cleaning a surface. One example of a cleaning machine is a carpet extractor that distributes water and detergent cleaning solution to a cleaning surface and substantially simultaneously extracts it along with the dirt on the carpet in a continuous operation. This machine generally uses one or two tanks for holding the cleaning solution and one tank for containing the extracted or recovered dirt and cleaning solution. When using this carpet extractor, the majority of this water is recovered and then discarded. Such an arrangement has several disadvantages. One is that at least two tanks are used which together provide about twice the tank volume that is need to hold the actual volume. Another is that the user has to carry the recovery tank when full to the sink for disposal of the recovered solution and then refill the solution tank(s).

To overcome these disadvantages, the carpet extractor can be designed to recycle the extracted cleaning solution for reuse. This solution would eliminate the additional recovery tank and the disposal of the recovered cleaning solution in the tank several times during the cleaning of the carpet with the carpet extractor. Further, this solution reduces significantly the number of times the user has to stop and refill the solution tank(s). It would also be desirable for such a carpet extractor that has a detergent tank to adjust the amount of detergent in the recycled water or the clean water from a different fluid source, if the extracted water is not reused, so that the ratio of detergent to water is optimized to produce the desired cleaning performance on the carpet.

SUMMARY OF THE INVENTION

The foregoing and other facets of the present invention will be readily apparent from the following description and the attached drawings. In one aspect of the invention, a cleaning apparatus for cleaning a surface in which cleaning solution is distributed to the surface and substantially simultaneously extracted along with the dirt on the surface in a continuous operation as it moves along the surface is provided. The cleaning apparatus includes a housing and a liquid distribution system operatively associated with the housing. The liquid distribution system includes a fluid source providing a supply of the cleaning solution and a distributor fluidly connected to the fluid source for distributing the cleaning solution to the surface. A liquid recovery system is operatively associated with the housing and includes a suction nozzle and a recovery tank removably mounted to the housing and in fluid communication with the suction nozzle. A suction source is in fluid communication with the suction nozzle for applying suction to draw the cleaning solution and dirt from the surface through the suction nozzle and into the recovery tank. A filter system is provided on the housing and in fluid communication with the recovery tank for filtering the recovered cleaning solution to be reused. The filter system includes a first filter provided on a filter support mounted to the recovery tank for filtering particles from the cleaning solution and dirt, and a second filter fluidly connected between the recovery tank and the distributor for filtering particles from the cleaning solution and dirt of a smaller size than the particles filtered from the first filter.

In another aspect of the invention, a cleaning apparatus for cleaning a surface in which cleaning solution is distributed to the surface and substantially simultaneously extracted along with the dirt on the surface in a continuous operation as it moves along the surface is provided. The cleaning apparatus includes a housing and a liquid distribution system operatively associated with the housing. The liquid distribution system includes a fluid source providing a supply of the cleaning solution and a distributor fluidly connected to the fluid source for distributing the cleaning solution to the surface. A liquid recovery system is operatively associated with the housing and includes a suction nozzle and a recovery tank removably mounted to the housing and in fluid communication with the suction nozzle. A suction source is in fluid communication with the suction nozzle for applying suction to draw the cleaning solution and dirt from the surface through the suction nozzle and into the recovery tank. A filter system is provided on the housing and in fluid communication with the recovery tank for filtering the recovered cleaning solution to be reused, wherein the filter assembly is composed of a polytetrafluoroethylene film.

In still another aspect of the invention, a cleaning apparatus for cleaning a surface in which cleaning solution is distributed to the surface and substantially simultaneously extracted along with the dirt on the surface in a continuous operation as it moves along the surface is provided. The cleaning apparatus includes a housing and a liquid distribution system operatively associated with the housing. The liquid distribution system includes a fluid source providing a supply of the cleaning solution and a distributor fluidly connected to the fluid source for distributing the cleaning solution to the surface. A liquid recovery system is operatively associated with the housing and includes a suction nozzle and a suction source in fluid communication with the suction nozzle for applying suction to draw the cleaning solution and dirt from the surface through the suction nozzle. An adjusting device is operatively connected to the detergent tank and the cleaning solution from the fluid source. The adjusting device detects the concentration of detergent in the cleaning solution and adjusts the flow of detergent from the detergent tank to the cleaning solution to a predetermined value based on the concentration of detergent in the cleaning solution detected by the adjusting device.

BRIEF DESCRIPTION OF THE DRAWINGS

The invention will now be described, by way of example, with reference to the attached drawings, of which.

DETAILED DESCRIPTION OF THE INVENTION

Figure 1:
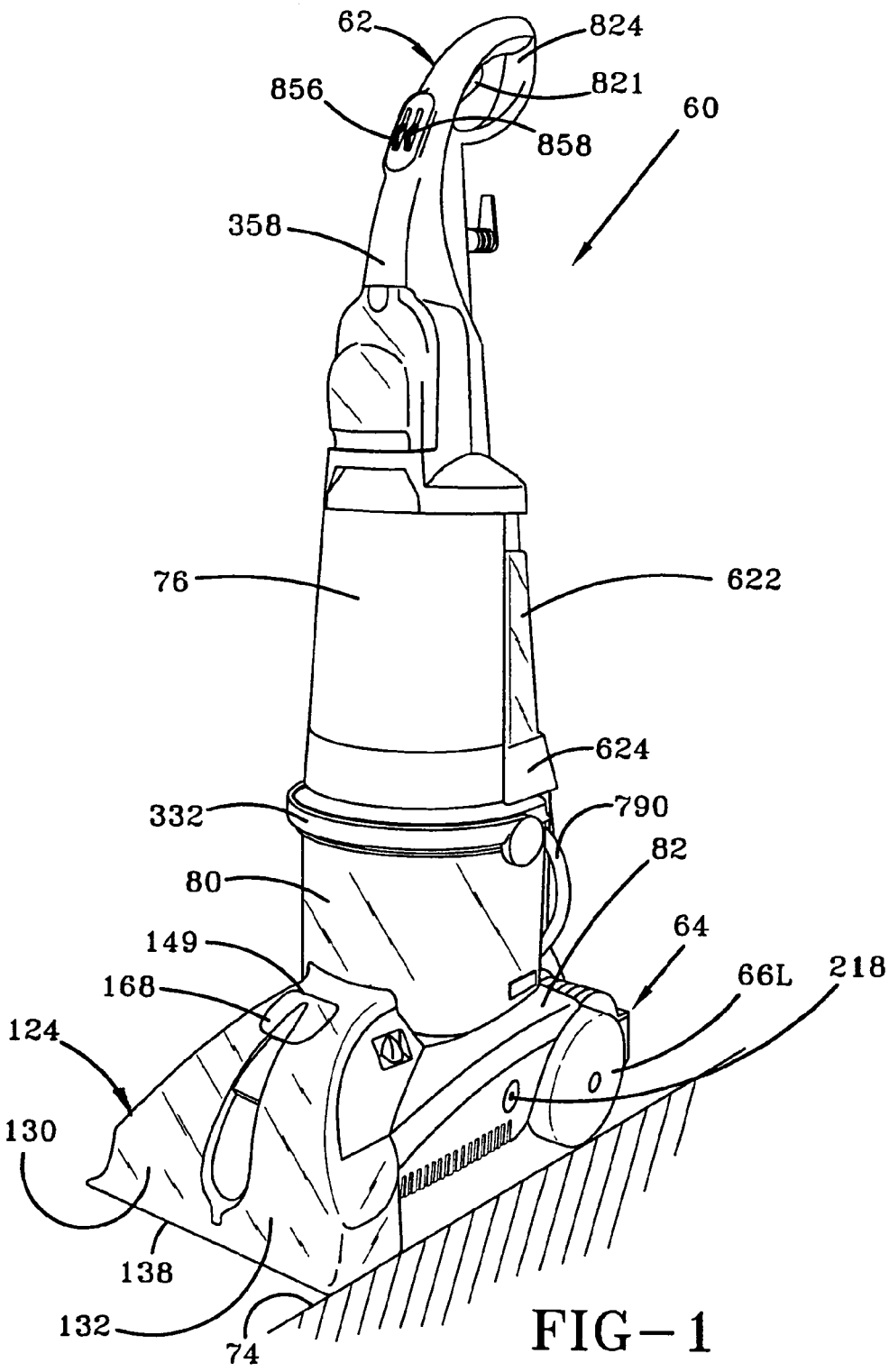
FIG. 1 is a perspective view of a carpet extractor embodying the present invention.

Referring to the drawings, FIG. 1 depicts a perspective view of an upright carpet extractor 60 according to one embodiment of the present invention. The upright carpet extractor 60 comprises an handle portion 62 pivotally connected to the rear portion of the floor-engaging portion or base assembly 64 that moves and cleans along a surface 74 such as a carpet.

Figure 2:
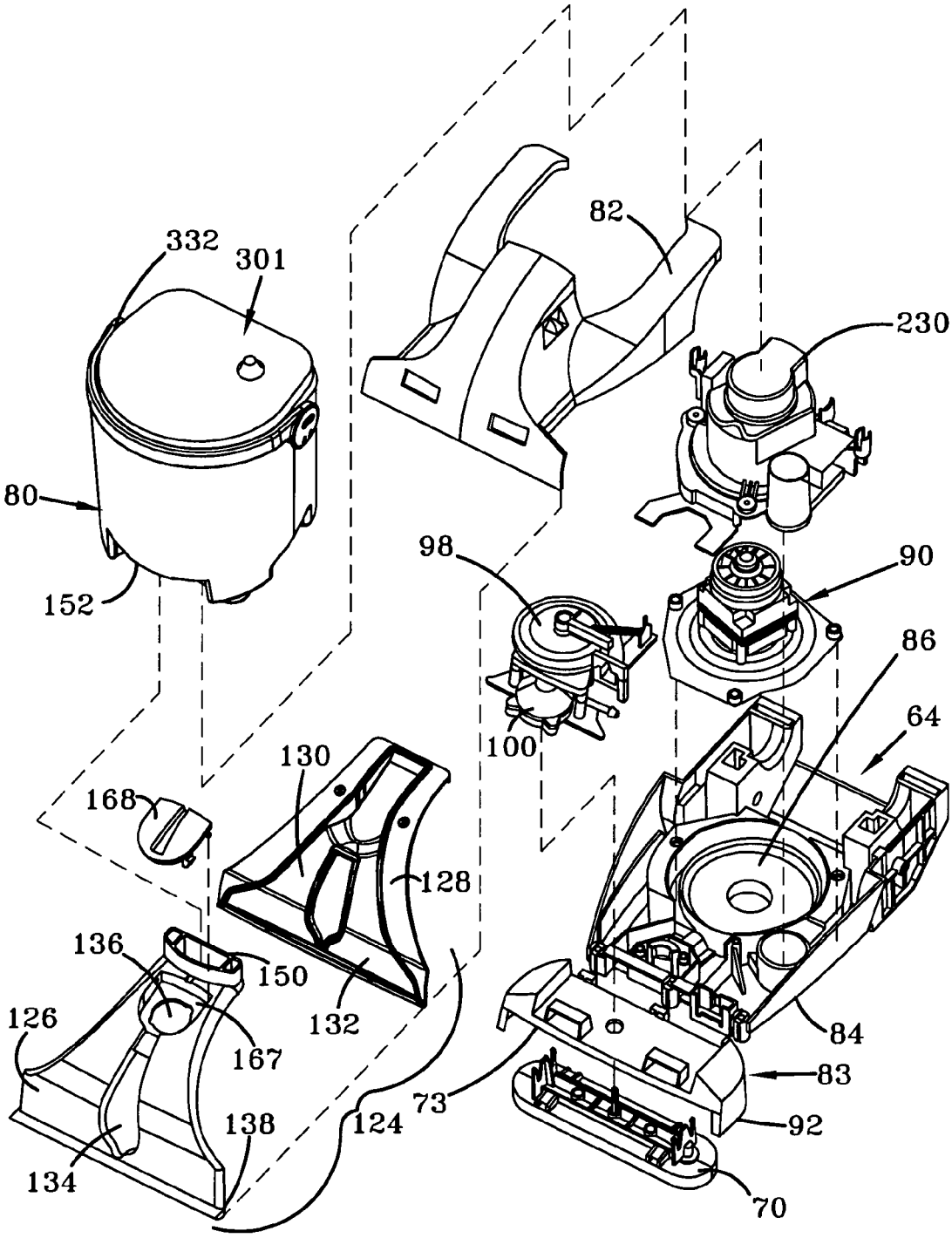
FIG. 2 is an exploded view of the base assembly of the carpet extractor illustrating the principal elements thereof.

A housing 76 is mounted to the handle portion 62 of the extractor 60 and houses several components of the extractor 60, which will be further described. A combined air/water separator and recovery tank 80 removably sets atop base assembly 64 and is surrounded by a hood portion 82. Before the extractor is used for cleaning the surface, the recovery tank 80 is filled with cleaning solution such as clean water. Referring to FIG. 2, the base assembly 64 includes a frame assembly 83 which comprises a generally unitary molded rear body 84 having two laterally displaced wheels 66 (the left wheel 66L being shown in FIG. 1) rotatably attached to the rear of the rear body 84. Integrally molded into the bottom of the rear body 84 is a circular stepped basin 86 receiving therein a motor/fan assembly 90 used to provide the suction power. The motor/fan assembly 90 is in fluid communication with the recovery tank 80. A suitable motor/fan assembly is shown in U.S. Pat. No. 5,500,977, the disclosure of which is incorporated by reference.

The base assembly 64 includes a brush assembly 70 having a plurality of rotating scrub brushes 72 (FIG. 3) for scrubbing the surface. An air driven turbine 98 providing motive power for the brush assembly 70 is mounted on the front portion of the rear body 84. The brush assembly 70 is contained in a brush cavity 73 formed in the underside of the front body 92. A suitable brush assembly 70 is taught in U.S. Pat. No. 5,867,857; the disclosure which is incorporated herein by reference. Brush assembly 70 is operated by a suitable gear train (or other known means), not shown, contained in transmission housing 100. A suitable air turbine driven gear train is taught in U.S. Pat. No. 5,443,362; the disclosure of which is incorporated by reference.

Turning back to FIGS. 1 and 2, a floor suction nozzle assembly 124 is removably mounted to the hood portion 82 of the base assembly 64. In particular, the floor suction nozzle assembly 124 includes a front plate 126 secured to a rear plate 128 that in combination define dual side ducts 130, 132 separated by a tear drop shaped opening 134 as best depicted in FIG. 2. The opening 134 extends down from an accessory hose opening 136, formed in the front portion 126, to a predetermined distance above the suction inlet 138 of the floor suction nozzle assembly 124. A door 168 is pivotally connected to the front portion 126 and releasably fits into the complimentary recess 167 to cover the opening 136 when the carpet extractor 60 is used to clean the floor.

The front and rear plates or portions 126, 128 are secured to one another by ultrasonic welding and screw fasteners, however, other types of ways to secure them such as for example, by adhesive, can be used. The distance above the suction inlet 138 for the opening 134 is about one fourth of an inch, which provides a flow path for liquid and dirt pick up in the center of the suction inlet 138 of the nozzle 124. The side ducts 130, 132 converge upstream into a recessed throat portion 149 (FIG. 1), which terminates into an upwardly extending rear duct 150. The rear duct 150 is positioned in a complementary recess portion 152 formed in the front lower portion of the recovery tank 80. The duct 150 fluidly connects with the recovery tank 80.

As depicted in FIG. 2, the recovery tank 80 sets down over and surrounds a portion of the motor cover 230 of base frame assembly 64. It is preferred that recovery tank 80 set atop and surround a portion of the motor fan assembly 90 thereby providing sound insulating properties and assisting in noise reduction of the extractor. A unshaped carrying handle 332 is pivotally connected to the upper portion of the recovery tank 80. The recovery tank lid assembly 301 incorporates therein the air/fluid separator. The motor/fan assembly 90 extracts the air and soiled liquid from the carpet and draws it through the suction nozzle 124 and side suction ducts 130, 132 to the lid assembly 301 of the recovery tank 80 where separation of the air and liquid occurs.

The recovery tank 80 includes a filter basket or frame 211 that supports a coffee type disposable filter 213 removably mounted on the filter basket 211 and aligned below the lid 301. The coffee type filter 213 is composed of a polytetrafluoroethylene film, which has good dirt release and filtering properties. To remove the filter 213, a user first removes the lid 301 to gain access to the filter 213. The filter 213 generally filters out large particles, fibers, and hairs from the extracted cleaning solution traveling from the lid 301 and passing through it to the bottom of the recovery tank 80. The liquid collects in the bottom of the recovery tank 80 and is reused as cleaning solution after being further treated, which will be further explained in more detail.

A detergent supply tank 622 with cap 720 (FIG. 3) is adhesively mounted to the housing 76 as depicted in FIG. 1. Alternatively, an additional clean water tank can be removably mounted to the handle 62 and filled with detergent or any other desired fluid such as liquid protectant or a fragrance emitting solution. The detergent supply tank 622 is positioned upon a bottom base 624 and is removably mounted to the handle 60.

Figure 3:
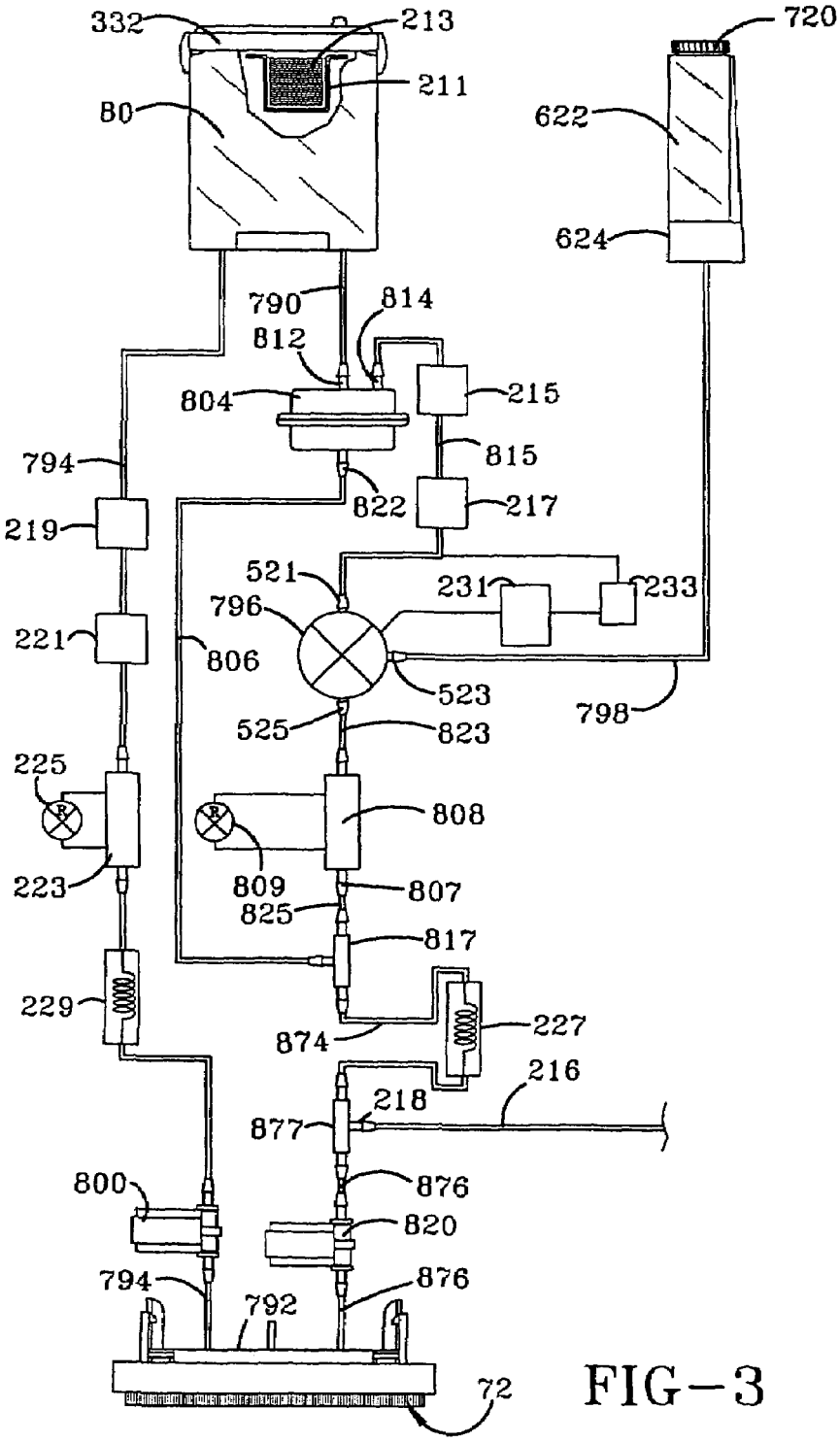
FIG. 3 is a schematic view of the fluid distribution system of the embodiment shown in FIG. 1.

FIG. 3 illustrates the overall solution distribution system, which will be described below. The carpet extractor includes a solution hose 790 that fluidly connects an outlet of the recovery tank 80 to an inlet 812 of a pressure actuated shut off valve 804. The outlet of the detergent tank 622 is fluidly connected to an inlet 523 of an electrically controlled variable mixing valve 796 via a suitable flexible hose 798.

The pressure actuated shut off valve 804 is fluidly connected between the recovery tank 80 and the mixing valve 796 for turning off and on the flow of water. This shut off valve 804 is opened and closed by outside pressure via a conduit 806 connected between it and the outlet 807 of a pump 808 through a Tee 817. The valve 804 includes a pressure port 822 fluidly connected to the outlet 807 of pump 808. An outlet 814 of the valve 814 is fluidly connected to an inlet 521 of the mixing valve 796 via hose 815. It should be known that recovery tank 80 could be fluidly connect to the outlet 814 of the valve 804 with the inlet 812 of the valve 804 being fluidly connect to the mixing valve 796 so that fluid could flow the opposite direction if desired.

In operation, when the pressure at the pressure port 822 is below a predetermined value such as between 7 to 10 psi, the valve 804 opens to allow water to flow in both directions. Such a pressure value at the pressure port 822 occurs when the main shut off valve 820 is opened and the pump 808 is turned on. The pump 808 also pressurizes the cleaning solution to draw it to the distributor 792. When the pressure exceeds a second predetermined value such as between 20 to 30 psi, the valve 804 closes. This would occur if the main shut off valve 820 is closed and the pump is turned on. Thus, with the valve 804 closed, the cleaning solution is prevented from flowing through it. Various types of pumps can be used such as a piston pump, gear pump or centrifugal pump.

A sediment filter 215 is disposed in the hose 815 and fluidly connected between the outlet 814 of the shut off valve 804 and inlet 521 of the mixing valve 796. The sediment filter 215 filters out particles smaller than those filtered out by the coffee type filter 213. In particular, the sediment filter 215 removes particles down to about 5 microns. A charcoal filter 217, disposed downstream of the sediment filter 215, is fluidly connected to the inlet 521 of the mixing valve 796. The charcoal filter 217 filters out particles smaller than those of the sediment filter. Specifically, the charcoal filter 217 filters out detergent residue and oils from the cleaning solution.

Outlet 525 of the mixing valve 796 is fluidly connected via flexible hose 823 to the inlet of the pump 808, which provides pressure to draw the cleaning solution to the distributor 792, when it is turned on. A relief valve 809 is fluidly connected across the pump 808 to limit the pressure at the outlet 807 of the pump 808 to a predetermine value. The outlet 807 of the pump 808 is fluidly connected to the main shut off valve 820 via flexible hoses 825, 874 and 876. A heater 227 is disposed in the solution hose 874 to heat the cleaning solution. One example of such a heater is the heater disclosed in U.S. Pat. No. 6,131,237; the disclosure of which is incorporated herein-by reference.

The carpet extractor 60 includes another solution hose 794 that fluidly connects another outlet of the recovery tank 80 to a shut off valve 800 used for selectively turning on and off the flow of clean water, which is filtered by a sediment filter 219 disposed in the solution hose 794 and charcoal filter 221 disposed in the solution hose 794 downstream of the sediment filter 219. Both of the filters 219, 221 are similar to their respective filters 215, 217. A pump 223 with relief valve 225, which is similar to pump 808 and relief valve 809, is provided in the solution hose 794 and fluidly connected between the charcoal filter 221 and shut off valve 800 to pressurize and draw the clean water to the distributor 792. A heater 229 similar to heater 227 is disposed in the solution hose 794 downstream of the pump 223 to heat the cleaning solution. Both of the shut off valves 800, 820 are in the form of a solenoid valve, however, other electrical actuated valves could be also used A microcontroller 231 is electrically coupled to the mixing valve 796 to control the mixing ratio of detergent from the detergent tank 622 and filtered clean water from the recovery tank 80. A pH sensor 233 is connected in the portion of the solution hose 815 between the charcoal filter 217 and the inlet 521 of the mixing valve 796 to detect the pH level of the water. The output of the pH sensor 233 is electrically coupled to an input of the microcontroller 231. In operation, the pH sensor 233 outputs a signal representative of the pH level of the water to the input of the microcontoller 231. The microcontroller 231 utilizes a look up table to convert the pH level to the concentration of detergent in the water. The microcontroller 231 then outputs a control signal representative of the concentration of detergent in the water to the mixing valve 796. Based on this control signal, the mixing valve 796 adjusts the flow of detergent from the detergent tank 622 to the cleaning solution at a value that provides the optimum concentration of detergent in the cleaning solution for the best cleaning performance using the extractor 60. Alternatively, a clean water tank could be used instead of the recovery tank 80 in this system for adjusting the concentration of detergent of the cleaning solution.

The valves 800, 820 are operated by a trigger switch 821 as depicted in FIG. 1. The trigger switch 821 is pivotally connected to the upper handle portion 358 approximately near a closed looped handgrip 824. Slide switch 858 is used to select one of the shut off valves 800, 820 to be opened and closed by the trigger switch 821. Slide switch 856 is the main power switch, which turns on and off the suction motor 90 and pumps 808, 223. The cleaning solution flows to their associated shut off valves 800, 820. The cleaning liquid distributor 792 evenly distributes the cleaning solution to each of the rotary scrub brushes 72. The scrub brushes 72 then spread the cleaning solution onto the carpet (or bare floor), scrub the cleaning liquid into the carpet and dislodge embedded soil. A solution discharge valve 877 allows the mixed detergent and clean water to flow through an integrally formed nipple 218 and a detachable solution tube 216 to a hand-held cleaning attachment (not shown) and dispense by typical spray means.

In operation, a user fills the recovery tank 80 with clean water and the detergent tank 622 with detergent. The user then pivots the handle 62 in an incline position while moving the carpet extractor 60 over the surface to clean it. The carpet extractor 60 distributes the cleaning solution to the carpeted surface using the brushes 72 and substantially simultaneously extracts it along with the dirt on the carpet in a continuous operation. The soiled cleaning solution is extracted from the carpet by the suction nozzle 124 and transported into the recovery tank 80 where the liquid and air are separated. The extracted liquid is filter and reused as cleaning solution as previously mentioned. A vacuum is created in the recovery tank 80 by the suction motor 90, which draws air from the recovery tank 80 and exhausts the air to the carpeted surface 74. Alternatively, the exhausted air could be fluidly connected to solution hose 790 to provide additional pressure to increase the cleaning solution flow rate. Further details of the carpet extractor are disclosed in published patent application No. 2003/0226230; the disclosure being incorporated herein by reference.

The present invention has been described by way of example using the illustrated embodiments. Upon reviewing the detailed description and the appended drawings, various modifications and variations of the embodiments will become apparent to one of ordinary skill in the art. All such obvious modifications and variations are intended to be included in the scope of the present invention and of the claims appended hereto.

In view of the above, it is intended that the present invention not be limited by the preceding disclosure of the embodiments, but rather be limited only by the appended claims.

What is claimed is:

1. A portable cleaning apparatus for cleaning a surface in which cleaning solution is distributed to the surface and substantially simultaneously extracted along with dirt on the surface in a continuous operation as it moves along the surface comprising:

a) a housing mounted to a handle assembly pivotally connected to a base assembly;

b) a liquid distribution system operatively associated with said housing and including:

a fluid source providing a supply of the cleaning solution, said fluid source being mounted to said housing;

a distributor fluidly connected to said fluid source for distributing the cleaning solution to the surface;

c) a liquid recovery system mounted to said base assembly and operatively associated with said housing, said liquid recovery system including:

a suction nozzle;

a recovery tank removably mounted to said housing and in fluid communication with said suction nozzle;

a suction source in fluid communication with said suction nozzle for applying suction to draw the cleaning solution and dirt from the surface through the suction nozzle and into said recovery tank; and d) a filter system provided on said housing and in fluid communication with said recovery tank for filtering the recovered cleaning solution to be reused, said filter system comprising:

a first filter provided on a filter support mounted to said recovery tank, said first filter filtering particles from the cleaning solution and dirt;

a second filter fluidly connected between said recovery tank and said distributor, said second filter filtering particles from the cleaning solution and dirt of a smaller size than the particles filtered from said first filter, wherein said handle is pivoted and manipulated to move said base assembly relative to the surface.

2. The portable cleaning apparatus of claim 1 wherein said filter system includes a third filter fluidly connected between said second filter and said distributor, said third filter filtering particles from the cleaning solution and dirt of a smaller size than the particles filtered from said second filter.

3. The portable cleaning apparatus of claim 2 wherein said third filter filters out detergent residue from the cleaning solution.

4. The portable cleaning apparatus of claim 3 wherein said third filter is composed of charcoal.

5. The portable cleaning apparatus of claim 2 wherein said first filter comprises a polytetrafluoroethylene film.

6. The portable cleaning apparatus of claim 1 wherein said first filter is a coffee filter.

7. The portable cleaning apparatus of claim 1 wherein said second filter filters out particles greater than or equal to 5 microns.

8. The portable cleaning apparatus of claim 1 including a pump fluidly connected between said recovery tank and said distributor for drawing the cleaning solution from said recovery tank to said distributor.

9. The portable cleaning apparatus of claim 1 including a detergent tank fluidly connected to said second filter for supplying detergent to the cleaning solution.

10. The portable cleaning apparatus of claim 1 including a handle pivotally connected to said housing.

11. The portable cleaning apparatus of claim 1 including a heater fluidly connected between said recovery tank and said distributor for heating the cleaning solution from said recovery tank.

12. The portable cleaning apparatus of claim 1 wherein said fluid source is provided in said recovery tank.

13. A cleaning apparatus for cleaning a surface in which cleaning solution is distributed to the surface and substantially simultaneously extracted along with dirt on the surface in a continuous operation as it moves along the surface comprising:

a housing;

b) a liquid distribution system operatively associated with said housing and including:

a fluid source providing a supply of the cleaning solution;

a distributor fluidly connected to said fluid source for distributing the cleaning solution to the surface;

c) a liquid recovery system operatively associated with said housing and including:

a suction nozzle;

a recovery tank removably mounted to said housing and in fluid communication with said suction nozzle;

a suction source in fluid communication with said suction nozzle for applying suction to draw the cleaning solution and dirt from the surface through the suction nozzle and into said recovery tank;

d) a filter system provided on said housing and in fluid communication with said recovery tank for filtering the recovered cleaning solution to be reused, said filter system comprising:

a first filter provided on a filter support mounted to said recovery tank, said first filter filtering particles from the cleaning solution and dirt;

a second filter fluidly connected between said recovery tank and said distributor, said second filter filtering particles from the cleaning solution and dirt of a smaller size than the particles filtered from said first filter;

e) a detergent tank fluidly connected to said second filter for supplying detergent to the cleaning solution; and f) an adjusting device operatively connected to said detergent tank and the cleaning solution from said recovery tank, said adjusting device detecting the concentration of detergent in the cleaning solution and adjusting the flow of detergent from said detergent tank to the cleaning solution to a predetermined value based on the concentration of detergent in the cleaning solution detected by said adjusting device.

14. A cleaning apparatus for cleaning a surface in which cleaning solution is distributed to the surface and substantially simultaneously extracted along with dirt on the surface in a continuous operation as it moves along the surface comprising:

a) a housing;

b) a liquid distribution system operatively associated with said housing and including:

a fluid source providing a supply of the cleaning solution;

a distributor fluidly connected to said fluid source for distributing the cleaning solution to the surface;

c) a liquid recovery system operatively associated with said housing and including:

a suction nozzle;

a recovery tank removably mounted to said housing and in fluid communication with said suction nozzle;

a suction source in fluid communication with said suction nozzle for applying suction to draw the cleaning solution and dirt from the surface through the suction nozzle and into said recovery tank;

d) a filter assembly provided on said housing and in fluid communication with said recovery tank for filtering the recovered cleaning solution to be reused;

e) a detergent tank fluidly connected to said filter assembly for supplying detergent to the cleaning solution; and f) an adjusting device operatively connected to said detergent tank and the cleaning solution from said recovery tank, said adjusting device detecting the concentration of detergent in the cleaning solution and adjusting the flow of detergent from said detergent tank to the cleaning solution to a predetermined value based on the concentration of detergent in the cleaning solution detected by said adjusting device, wherein said filter assembly includes a polytetrafluoroethylene film.

15. The cleaning apparatus of claim 14 including a handle pivotally connected to said housing.

16. The cleaning apparatus of claim 14 including a heater fluidly connected between said recovery tank and said distributor for heating the cleaning solution.

17. The cleaning apparatus of claim 14 wherein said fluid source is provided in said recovery tank.

18. A cleaning apparatus for cleaning a surface in which cleaning solution is distributed to the surface and substantially simultaneously extracted along with dirt on the surface in a continuous operation as it moves along the surface comprising:

a) a housing;

b) a liquid distribution system operatively associated with said housing and including:

a fluid source providing a supply of the cleaning solution;

a detergent tank removably mounted to said housing and providing a supply of detergent to the cleaning solution;

a distributor fluidly connected to said fluid source for distributing said cleaning solution to the surface;

c) a liquid recovery system operatively associated with said housing and including:

a suction nozzle;

a suction source in fluid communication with said suction nozzle for applying suction to draw the cleaning solution and dirt from the surface through the suction nozzle; and d) an adjusting device operatively connected to said detergent tank and the cleaning solution from said fluid source, said adjusting device detecting the concentration of detergent in the cleaning solution and adjusting the flow of detergent from said detergent tank to the cleaning solution to a predetermined value based on the concentration of detergent in the cleaning solution detected by said adjusting device.

19. The cleaning apparatus of claim 18 wherein said fluid source is a recovery tank containing the cleaning solution, said recovery tank removably mounted to said housing and in fluid communication with said suction nozzle such that at least the extracted cleaning solution transported through the suction nozzle deposits into said recovery tank for reuse.

20. The cleaning apparatus of claim 18 wherein said adjusting device comprises a valve device fluidly connected between said detergent tank and said fluid source, a detecting device operatively associated with the cleaning solution for detecting the concentration of detergent in the cleaning solution, said detector outputting a signal representative of the detected concentration of detergent in the cleaning solution, a controller coupled to said detecting device and said valve device, said controller controlling said valve device to allow detergent from said detergent to flow to the cleaning solution from said fluid source at a predetermined amount based on said signal.

21. The cleaning apparatus of claim 18 wherein said adjusting device detects the pH level of the cleaning solution corresponding to the concentration of detergent in the cleaning solution.

* * * * *